US007585178B1

(12) United States Patent
Abrahamsson et al.

(10) Patent No.: US 7,585,178 B1
(45) Date of Patent: Sep. 8, 2009

(54) CONNECTOR ARRANGEMENT OF MULTIPLE INDEPENDENTLY OPERABLE ELECTRICAL CONNECTORS

(75) Inventors: Jenny Abrahamsson, Lomma (SE); Ingemar Thulin, Sodra Sandby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/050,444

(22) Filed: Mar. 18, 2008

(51) Int. Cl.
*H01R 13/62* (2006.01)

(52) U.S. Cl. ..... 439/309; 439/670

(58) Field of Classification Search ..... 439/309, 439/20, 23, 28, 11, 17, 660, 670
See application file for complete search history.

(56) References Cited

U.S. PATENT DOCUMENTS 6,099,349 A * 8/2000 Boutros ..... 439/541.5
6,113,415 A * 9/2000 Bertsch et al. ..... 439/353
6,869,316 B2 * 3/2005 Hinkle et al. ..... 439/675
7,140,911 B1 * 11/2006 Rector et al. ..... 439/540.1
7,195,519 B1 * 3/2007 McAlonis et al. ..... 439/608
7,467,977 B1 * 12/2008 Yi et al. ..... 439/607
2007/0077818 A1 * 4/2007 Iwakawa ..... 439/610
2008/0188122 A1 * 8/2008 Edeler et al. ..... 439/540.1

* cited by examiner

*Primary Examiner*—Hae Moon Hyeon
(74) *Attorney, Agent, or Firm*—Harrity & Harrity, LLP

(57) ABSTRACT

A connector arrangement including a connector body; a first electrical connector coupled with the connector body; a jacket surrounding the first electrical connector and coupled with the connector body; and a second electrical connector arranged around the first electrical connector is provided; in which the first and second electrical connectors are independently operable, and the second electrical connector includes connecting elements at least partially arranged within a body of the jacket.

19 Claims, 5 Drawing Sheets

CONNECTOR ARRANGEMENT OF MULTIPLE INDEPENDENTLY OPERABLE ELECTRICAL CONNECTORS

BACKGROUND OF THE INVENTION

The present invention generally relates to connector arrangements and, more particularly to connectors for electrically connecting devices.

Generally, to connect two electrical devices to each other, various kinds of connectors may be used. Electrical device in this context is to be understood as encompassing any kind of device, for example mobile devices like mobile computers, mobile phones, personal digital assistants (PDAs) and the like, stationary devices like home computers, peripheral devices like hard disks, modems and also connecting cables used to transmit signals and the like to other devices. For example, to connect a desktop computer with a mobile device, a first electrical connector may be provided at the desktop computer, which is connected with a connector at one end of a cable, and a connector at the other end of the cable may be connected to a connector of the mobile device.

To facilitate connections between devices, some standardized connectors have been developed which are widely used, for example universal serial bus (USB) connectors or IEEE1394 connectors. Of these standardized connectors, different communication protocols with different data rates like USB 1.1 and USB 2.0 or IEEE1394a and IEEE1394b and/or different physical implementations of the connectors like mini USB, USB-A, USB-B and the like may be specified.

Such standardized connectors facilitate communication between devices since for example one and the same USB cable may be used for various different devices. On the other hand, while such standardized connectors are in many cases designed to fulfill the needs of a variety of applications, they may not be optimized for a specific application.

On the other hand, for many specific applications connectors individually designed for the respective purpose are used. Such connectors may in some cases provide better performance for the specific application, but require dedicated equipment, for example cables, which are only usable with the specific connector.

Therefore, a general need exists for improved connectors and connector arrangements.

SUMMARY OF THE INVENTION

According to an embodiment of the invention, a connector arrangement is provided comprising a first electrical connector and a second electrical connector which is arranged around the first electrical connector. In embodiments of the present invention, "arranged around" means that portions of the second electrical connector are continuously or discontinuously arranged along one or more closed lines, e.g. circles, squares or rectangles, surrounding said first electrical connector. For example different portions of the second electrical connector are arranged on different sides of the first electrical connector, e.g. on two opposing sides or on four sides spaced apart approximately 90 degrees. In such an embodiment, the first electrical connector and the second electrical connector are configured to be operable independently of each other or, in other words, the first electrical connector may be used for transmitting signals, power and the like independently of using the second electrical connector and vice versa. "Electrical connector" in this respect refers to any connector which is usable to transmit electrical signals, currents, voltages and the like.

With the connector arrangement of this embodiment, a high degree of flexibility is achieved since the first electrical connector and the second electrical connector may be used independently. Moreover, by arranging the second electrical connector around the first electrical connector, a compact connector arrangement may be provided.

In another embodiment of the present invention, the first electrical connector may be implemented according to an industry standard. For example, the first electrical connector may be chosen from the group comprising a mini USB connector, a micro USB connector, a USB connector, a standard audio connector like a 3.5 mm audio connector and an IEEE1394 connector. In such an embodiment, a connection with the first electrical connector may be established using standard equipment according to the respective industry standard, while for example the second electrical connector may be used to provide additional features.

In a further embodiment, the connector arrangement includes a jacket surrounding said first electrical connector. In such an embodiment, the second electrical connector is associated with said jacket, for example incorporated in the jacket or otherwise connected with the jacket. Providing such a jacket may protect the connector arrangement for example against dust.

In an embodiment, the jacket may be made from a shielding material or contain such a shielding material, for example a metal, thus providing a shielding for the first electrical connector and/or the second electrical connector.

The jacket in an embodiment also may include a locking mechanism for locking the jacket to a further connector arrangement to be connected with the connector arrangement. In this way, the connection may be secured.

In a further embodiment, the jacket may be detachable from the connector arrangement. In such an embodiment, with the jacket and the second electrical connector associated therewith being detached the connector arrangement may be used as if only the first electrical connector were present.

In such an embodiment, the jacket may be connected with the connector arrangement via a flexible securing element like a wire, a cord, a strip or the like, to prevent loss thereof when the jacket is detached.

In another embodiment, the jacket may be reversibly deformable in such an embodiment, in a deformed state of the jacket the connector arrangement may be basically used as if only the first electrical connector were present. In such an embodiment, the jacket may for example include a memory metal.

In an embodiment, the second electrical connector may include a plurality of connecting elements arranged around said first electrical connector. In an embodiment, the connecting elements may be pins or balls.

In an embodiment where the above-mentioned jacket is provided, the connecting elements may be at least partially arranged within said jacket.

In such an embodiment, the jacket may include an ejection mechanism which is configured such that in a first state of the ejection mechanism the connecting elements protrude from said jacket towards an outside of said jacket and in a second state of said ejection mechanism the connecting elements are located closer to a center of the jacket than in the first state, for example retracted into said jacket. In such an embodiment, when in use for making a connection, the ejection mechanism may be in the first state, whereas when not in use, the ejection mechanism may be in the second state such that the connecting elements are protected by the jacket.

In an embodiment, such an ejection mechanism may include an inner ring member and an outer ring member. In such an embodiment, the inner ring member is rotatable with respect to the outer ring member, and the outer ring member includes openings for said connecting elements. In this embodiment, the inner ring member is coupled with the connecting elements to push said connecting elements through said openings in said first state. In this way, by a simple rotating movement the ejection mechanism may be changed between the first state and the second state.

In an embodiment, the connecting elements may include a plurality of pins, wherein one end of each of said pins is coupled with the above-mentioned inner ring member and the pins are guided by said openings of said outer ring member. In another embodiment, the connecting elements may include a plurality of balls, in which case the inner ring member may include a plurality of step elements at an outer surface thereof to move the balls between a first position associated with said first state and a second position associated with said second state.

In another embodiment, the second electrical connector may include a plurality of contact areas. Such a connector arrangement may for example be used to couple with the abovementioned connector arrangement which includes pins or balls, such that each pin or ball connects with one of the contact areas when the connection is established.

In an embodiment, the connector arrangement may include a ring element surrounding said first electrical connector, and the above-mentioned contact areas may be arranged in the ring element.

A connector arrangement as described above may be incorporated in any kind of electrical device and coupled to an electrical element like a circuit or a wire of the electrical device, for example a mobile device, a mobile phone, a personal digital assistant, a desktop computer or also a cable.

One or more of the above-described embodiments may be combined with each other unless specifically noted to the contrary.

DETAILED DESCRIPTION OF THE INVENTION

In the following, exemplary embodiments of the present invention will be described in detail. It is to be understood that the following description is given only for the purpose of illustration and is not to be taken in a limiting sense. The scope of the invention is not intended to be limited by the exemplary embodiments described hereinafter or by the drawings which are taken to be illustrative only.

It should be noted that the drawings are to be regarded as being schematic representations only, and the drawings are not necessarily to scale with each other. Also within a single drawing, elements are not necessarily depicted in scale with each other, but rather the representation of the various elements is chosen such that their function becomes apparent to a person skilled in the art.

In the following, different embodiments comprising a first electrical connector and a second electrical connector will be described. In all these embodiments, the first electrical connector for example may be a connector as defined by an industry standard like a mini USB connector, micro USB connector, USB connector, an audio connector like a 3.5 mm audio connector, or an IEEE1394 connector, wherein in each case a male or a female connector may be used but is not limited to these connectors. However, also first electrical connectors not complying with an industry standard may be used.

Figure 1:
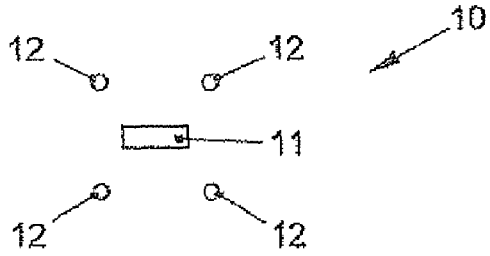
FIG. 1 shows a schematic representation of a connector arrangement according to an embodiment of the present invention.

In FIG. 1, a connector arrangement 10 according to an embodiment of the present invention is schematically shown. The connector arrangement 10 includes a first electrical connector 11. Furthermore, the connector arrangement 10 includes a second electrical connector formed by four contact pins 12 which are arranged around the first electrical connector 11. Instead of contact pins, other types of electrical contacting elements may be provided. For example, instead of connecting pins 12, also connecting sockets for receiving pins or contact areas or pads to be contacted by contacting elements like pins may be provided. In other words, as connecting elements both male and female connecting elements may be used.

Moreover, while four contact pins 12 are shown in FIG. 1, any number of contact pins or other electrical contacting elements may be provided around the first electrical connector 11. Also, the arrangement of the contact pins or other contacting elements is not limited to the arrangement shown, but any arrangement, for example an arrangement where the distance between the contact pins varies, or where the contact pins are arranged following two or more circles around first electrical connector 11 may be realized in corresponding embodiments of the present invention.

Figure 2:
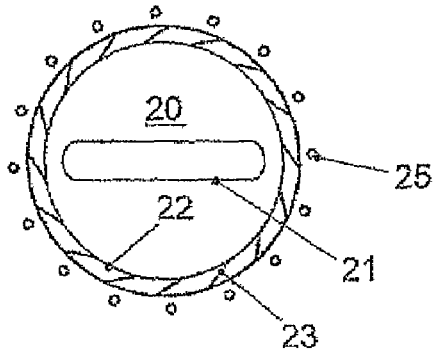
FIG. 2 shows a schematic representation of connector arrangements according to further embodiments of the present invention.

In FIG. 2, further embodiments of connector arrangements according to the present invention are schematically shown. A connector arrangement 20 according to an embodiment includes a first electrical connector 21 and a jacket 22 arranged around first electrical connector 21. Jacket 22 may be made of any suitable material, like a plastic material or a metal material. In case metal is fully or partially (for example in form of a metal web) used, jacket 22 may be used for shielding first electrical connector 21. To this end, the metal portions of jacket 22 in an embodiment may be connected to a reference potential like ground.

Inside jacket 22, a plurality of pins 23 are located forming a second electrical connector. In a first state shown in FIG. 2, pins 23 are essentially completely retracted within jacket 22. In the connector arrangement 20, jacket 22 includes an ejection mechanism (not shown) such that pins 23 may be moved to a second state where they protrude from jacket 22 towards an outside thereof. Embodiments of suitable ejection mechanisms will be discussed later.

Connector arrangement 20 shown in FIG. 2 is adapted to be coupled with a further connector arrangement which includes a first electrical connector configured to be coupled with first electrical connector 21 and a plurality of contact areas 25, for example contact pins, contact pads or sockets for receiving pins, forming a second electrical connector of the further connector arrangement which surrounds the first electrical connector of the further connector arrangement. For example, if first electrical connector 21 of connector arrangement 20 is a male USB connector, the corresponding first electrical connector of the further connector arrangement is a corresponding female USB connector. Furthermore, in a connected state between the connector arrangement 20 and the further connector arrangement as schematically shown in FIG. 2, each contact area 25 is associated with one of pins 23. When the ejection mechanism is activated, which in an embodiment may be done by turning jacket 22, pins 23 are ejected from the jacket such that each pin contacts the contact area 25 with which it is associated, thus establishing electrical contact between pins 23 and contact areas 25.

Figure 3:
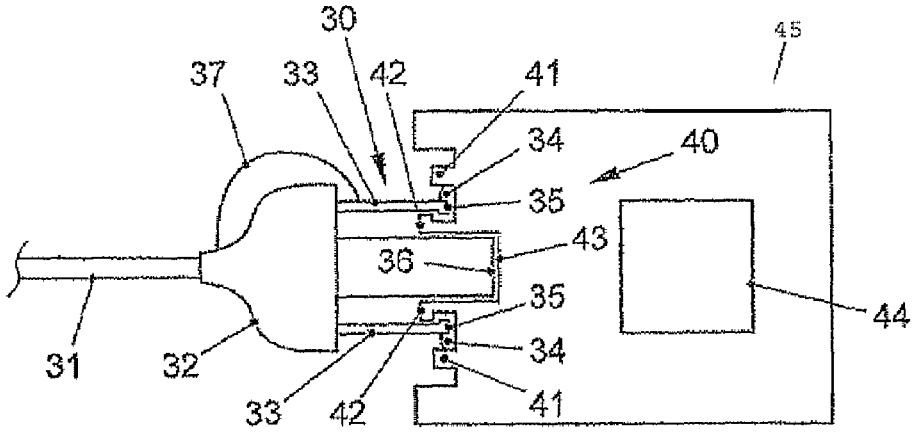
FIG. 3 shows a schematic cross-sectional view of connector arrangements according to other embodiments of the present invention.

Further embodiments of connector arrangements which are somewhat similar to the embodiments shown in FIG. 2 are shown in FIG. 3. FIG. 3 shows a schematic cross-sectional view where a cable 31 comprising a connector end 32 equipped with a connector arrangement 30 according to an embodiment of the present invention is connected with a mobile device 45 equipped with a connector arrangement 40 according to an embodiment of the present invention. Mobile device 45 may be any kind of mobile device like a mobile phone or a personal digital assistant and includes circuitry 44 coupled with connector arrangement 40. Cable 31 may be a shielded cable, an unshielded cable and the like. It should be noted that cable 31 and mobile device 45 merely serve as examples for devices which may be connected using connector arrangements according to embodiments of the present invention.

Connector arrangement 30 includes a male USB mini connector 36 arranged substantially at a center of connector arrangement 30 and a jacket 33 surrounding USB connector 36. Similar to the embodiment of FIG. 2, jacket 33 is provided with a plurality of pins 34 which in FIG. 3 are shown as extending from jacket 33 towards an outside thereof.

Pins 34 in an embodiment may be ejected from jacket 33 such that they protrude towards an outside thereof as shown and retracted into jacket 33 using an ejection mechanism. At an end of jacket 33, a projection 35 projecting towards an inside of jacket 33 is provided.

Connector arrangement 40 correspondingly includes a female USB connector 43 to be engaged with male USB connector 36 and a plurality of contact pins or contact pads 41 which in the state shown are contacted by pins 34. Furthermore, connector arrangement 40 includes projections 42 which in the state shown in FIG. 3 are engaged with projections 35. Projections 35 and 42 provide a locking mechanism for locking connector arrangement 30 to connector arrangement 40. In an embodiment, this locking mechanism may be provided only over a portion of the circumference of jacket 33 such that the locking mechanism may be engaged and disengaged by turning jacket 33.

In the embodiment of FIG. 3, jacket 33 is detachable from connector end 32. For example, jacket 33 may be connected to connector end 32 with a locking mechanism similar to the locking mechanism comprising projections 35 and 42, or jacket 33 at the end engaged with cable end 32 may include threads engaging with corresponding threads formed in cable end 32. When jacket 33 together with pins 34 is detached from cable end 32, a standard male USB connector remains which may be connected with any standard USB female connector.

In the embodiment of FIG. 3 a flexible strip 37 is provided coupling jacket 33 with connector end 32. Through strip 37, it is assured that jacket 33 when detached from cable end 32 does not get lost. Instead of a strip, a different flexible securing element like a wire or a cord may be provided.

In another embodiment, jacket 33 may be reversibly deformable to be deformed from the state shown in FIG. 3 to a deformed state where connector arrangement 30 may essentially be used as having only the male mini USB connector 36. To achieve such a reversible deformability, jacket 33 may include a so-called memory metal which "remembers" its original state when being deformed.

In the embodiments shown in FIG. 3, connector arrangement 30 comprising jacket 33 and a male USB connector is attached to cable 31, while connector arrangement 40 comprising connecting areas 41 and a female USB connector is attached to mobile device 45. However, in other embodiments, connector arrangement 30 may be attached to a mobile device, and connector arrangement 40 may be attached to a cable. Moreover, in a connector arrangement according to different embodiments, a jacket may be provided surrounding a female connector like a female USB connector, or connecting areas may be provided surrounding a male connector like a male USB connector. Therefore, the scope of the present invention is not be construed to be limited to any specific combination of first electrical connector and second electrical connector.

Figure 4:
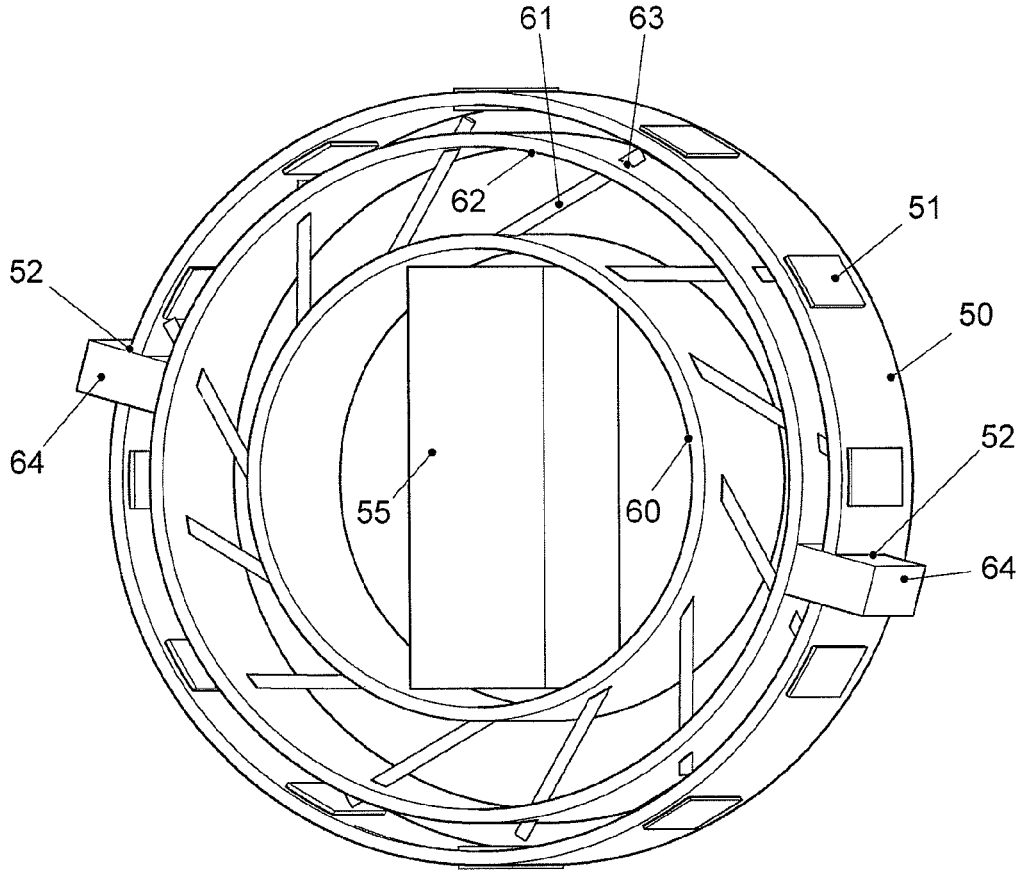
FIG. 4 shows a perspective view of portions of connector arrangements according to other embodiments of the present invention.
Figure 5:
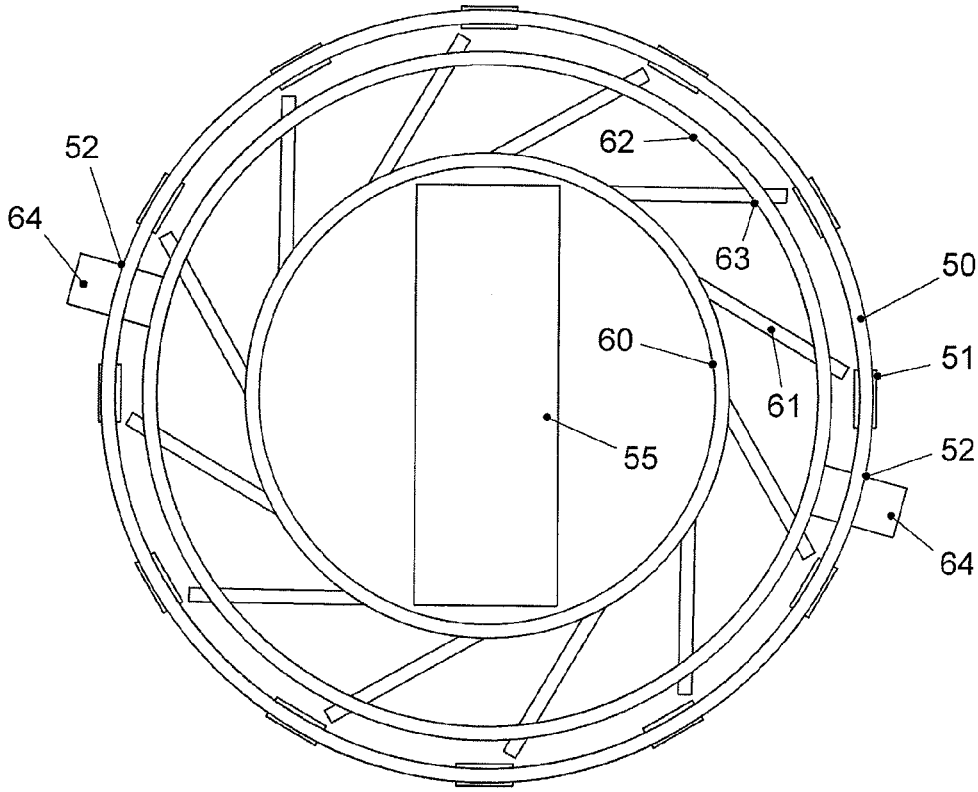
FIG. 5 shows another view of the portions of connector arrangements of FIG. 4.

Next, embodiments of ejection mechanisms which for example are usable for ejecting the pins from the jacket in the embodiments of FIGS. 2 and 3, but also in other embodiments of connector arrangements, will be discussed. In FIG. 4, a perspective view of portions of connector arrangements according to embodiments of the present invention comprising an ejection mechanism are shown, and FIG. 5 shows another view of these portions. Since FIGS. 4 and 5 focus on explaining an embodiment of an ejection mechanism, the respective first electrical connectors like the above-explained USB connectors are simply depicted as a black box 55.

In the embodiment of FIGS. 4 and 5, an ejection mechanism which for example may be integrated in a jacket like jacket 33 of FIG. 3 or jacket 22 of FIG. 2 includes an inner ring 60 and an outer ring 62. As contacting elements forming a second electrical connector besides the already mentioned USB or similar connector 55, a plurality of pins 61 is provided. One end of each pin is attached to inner ring 60. Outer ring 62 includes a plurality of openings 63, wherein one opening is assigned to each pin and the pins are guided through the respectively assigned openings 63. Outer ring 62 in the embodiment of FIGS. 4 and 5 further includes two protrusions 64.

As second electrical connector of a further connector arrangement a plurality of contact areas 51 are provided, which may in an embodiment for example correspond to contact areas 41 of FIG. 3 or contact areas 25 of the embodiment of FIG. 2. Contact areas 51 are arranged in a ring element 50. Ring element 50 furthermore includes cut-outs 52 for receiving protrusions 64 of outer ring 62 in a state where the connector arrangements are connected with each other.

In the embodiments of FIGS. 4 and 5, inner ring 60 and outer ring 62 are displaceable (e.g., rotatable) relative to one another. In an embodiment, this may be achieved by coupling inner ring 60 to an outer sleeve of a corresponding jacket. When inner ring 60 is rotated, pins 61 are radially displaced with respect to outer ring 60. When in the view of FIGS. 5 and 6 inner ring 60 is rotated in a clockwise direction, pins 61 are "pushed" to extend or project to the outside through opening 63 to engage contact areas 51, thereby establishing electrical contact between pins 61 and contact areas 51. When inner ring 60 is turned in the counter-clockwise direction, conversely pins 61 are retracted away from contact areas 51 through holes 63, to thereby electrically disconnect pins 61 from contact areas 51 or insulate pins 61 from contact areas 51. It should be noted that in a different embodiment the ejection mechanism may be designed such that a turning in the counter-clockwise direction ejects or the pins and a turning in the clockwise direction retracts the pins. In one embodiment, pins 61 extend tangentially from inner ring 60 in an insulated state, and pins 61 extend normally from inner ring 60 in an electrically conductive state.

In the embodiments of FIGS. 4 and 5, projections or protrusions 64 combined with cut-outs 52 serve two purposes: on the one hand, they lock the connector arrangements with each other and on the other hand they prevent a rotation of outer ring 62 with respect to ring element 50. In some embodiments, protrusions 64 may be depressed radially inward from a biased radially outward position to be disposed with an inner surface of outer ring 50. In such a position, protrusions 64 may be circumferentially displaced along the inner surface of outer ring to alignment with cut-outs 52, where protrusions 64 may biasly engage cut-outs 52.

While in the embodiment of FIGS. 4 and 5 two processes or protrusions 64 and two corresponding recesses or cut-outs 52 are shown, the number and also the position of the protrusions is not limited to the ones shown, and any suitable number of protrusions may be provided. Also other locking mechanisms or articulations, for example balls provided on outer ring 62 which fit into corresponding grooves in ring element 50 may be provided.

Figure 6:
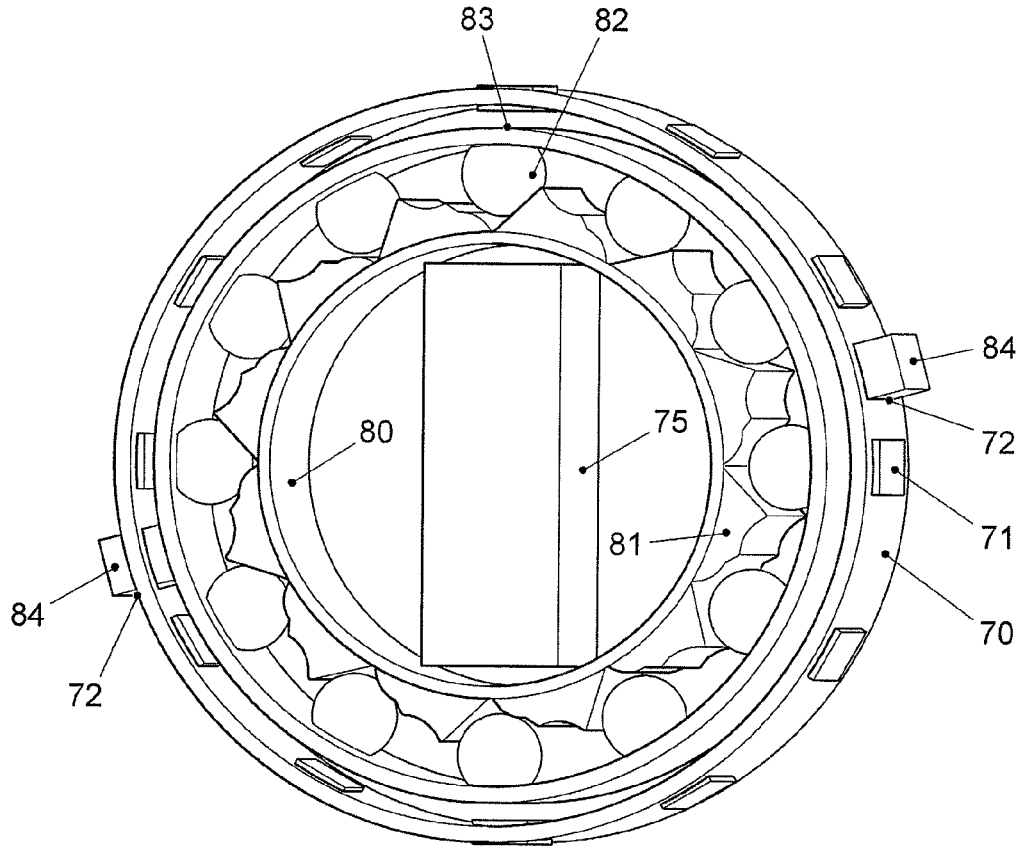
FIG. 6 shows a perspective view of portions of connector arrangements according to further embodiments of the present invention.
Figure 7:
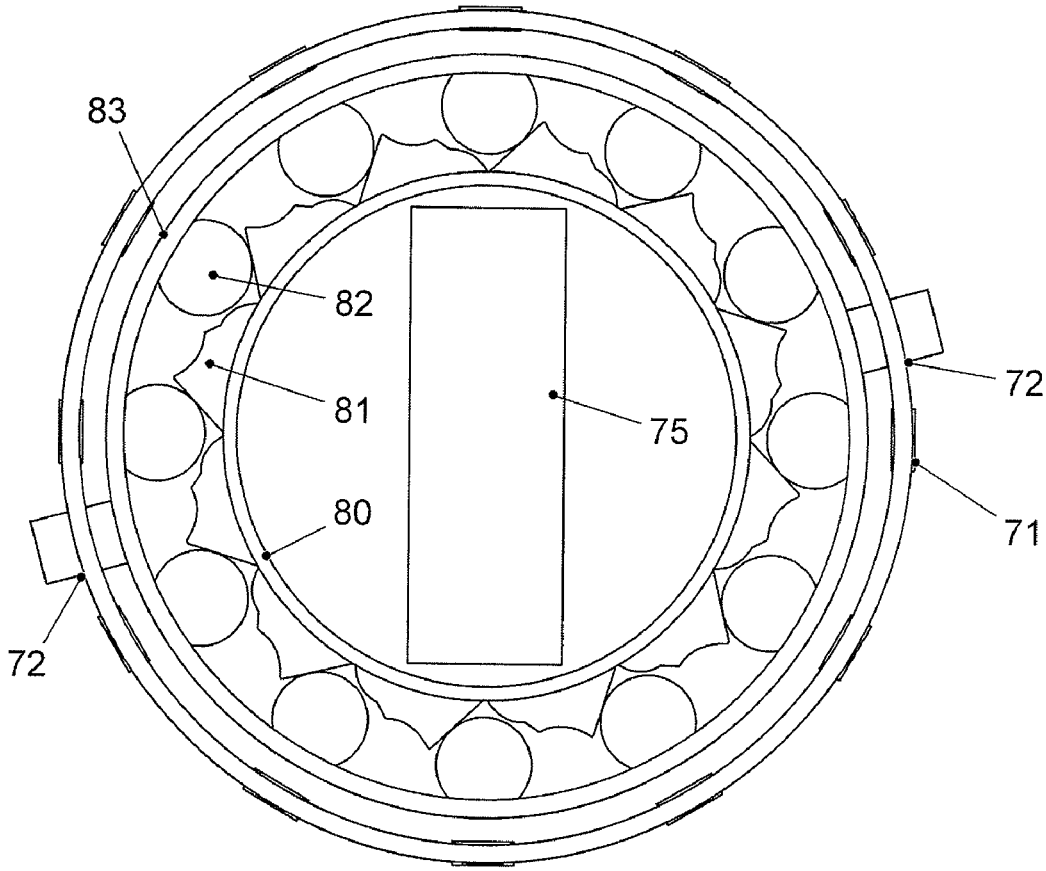
FIG. 7 shows another view of the portions of connector arrangements of FIG. 6.

In FIGS. 6 and 7, portions of connector arrangements according to further embodiments of the present invention comprising a further embodiment of an ejection mechanism are shown, wherein FIG. 6 shows a perspective view and FIG. 7 shows a further view. Similar to the embodiment of FIGS. 4 and 5, in the embodiment of FIGS. 6 and 7 the respective first electrical connectors like USB connectors or IEEE1394 connectors of connector arrangements illustrated, are shown as black box 75 since FIGS. 6 and 7 focus on the ejection mechanism. However, it is to be understood that any suitable first electrical connectors may be present.

Similar to the embodiment of FIGS. 4 and 5, a connector arrangement according to an embodiment shown in FIGS. 6 and 7 includes an inner ring 80 and an outer ring 83. Between inner ring 80 and outer ring 83 a plurality of balls 82 forming contacting elements of a second electrical connector are arranged and spaced apart evenly in the embodiment of FIGS. 6 and 7. In outer ring 83, openings are provided corresponding to the positions of balls 82. Outer ring 83 further includes protrusions 84.

A second electrical connector of a further connector arrangement includes contact areas 71 arranged in a ring element 70 similar to the embodiment of FIGS. 4 and 5. Ring element 70 includes cut-out 72 for engaging with protrusions 84. When protrusions 84 are engaged in cut-outs 72 balls 82 are essentially aligned with contact areas 71.

Furthermore, in the embodiments shown in FIGS. 6 and 7, step elements 81 are provided on an outer surface of ring 80. In the position shown in FIG. 6, each of the balls 82 rests essentially between two step elements 81 and does not protrude or protrudes only slightly through the openings provided in outer ring 83 towards an outside of outer ring 83 to thereby produce a non-electrically conducting or insulated state. Similar as described with respect to the embodiment of FIGS. 4 and 5, inner ring 80 is rotatable with respect to outer ring 83. When inner ring 80 is turned in a clockwise direction, balls 82 are moved "up" or traverse steps 81 and are thereby displaced to protrude through the openings provided in outer ring 83 and to engage contact areas 71, thereby establishing contact between the second electrical connectors of the connector arrangements involved. As a matter of course, the form of step elements 81 shown in FIGS. 6 and 7 is to be taken as an example only, and other step structures may be used for moving balls 82 between a state where they are substantially retracted between outer ring 83 and inner ring 80 and a state where they protrude from outer ring 83 to engage contact areas 71.

Regarding the number and position of protrusions 84 and cut-outs 72, the same possibilities for modifications as already discussed with respect to FIGS. 4 and 5 apply.

Moreover, the number of pins 61 in the embodiment of FIGS. 4 and 5 and the number of balls 82 in the embodiment of FIGS. 6 and 7 illustrated is to be taken as an example only, and any number of respective contacting elements like pins or balls, or combinations thereof, may be used as desired for any particular application. Furthermore, while in the embodiments of FIGS. 4-7 the contacting elements, i.e., pins or balls, are regularly spaced apart from each other, a varying spacing between the contacting elements may also be used. Further, while substantially square-shape contacting areas 51, 71 and ring elements 50, 70, respectively, are shown in the figures, the contact areas may assume any suitable shape for making electrical contact with the respective contacting elements, for example pins 61 or balls 82. Still further, shapes and/or dimensions of the contacting elements and/or steps 81 corresponding to their respective contact areas 51, 71 may vary among the contacting elements so that different electrical connections may be established at different degrees of rotation of inner rings 60 and 80, for example. That is, a first rotation position from an insulated position may cause a first predetermined number of contact elements to engage their respective contact areas while another number of contact elements do not engage their respective contact areas; a second rotation position from the first rotation position may cause a second predetermined number of contact elements to engage their respective contact areas while still another number of contact elements do not engage their respective contact areas; and so on, for a third rotation position, a fourth rotation position, or any number of rotation positions. Still further, some of the predetermined first number of contact elements may disengage their respective contact areas in the second rotation position based on, for example, the shape of steps 81 (e.g., multi-step) or multiple ball sizes corresponding to the predetermined first number of contact elements, different lengths of pins 61, etc.

Embodiments of the present invention provide an adjustable and/or universal connector.

The embodiments of ejection mechanisms discussed with reference to FIGS. 4-7 are intended to serve only as an example how an ejection mechanism may be implemented and are not to be construed as limiting the scope of the present application to these particular ejection mechanisms. Other ejection mechanisms may be employed as well, for example ejection mechanisms based on elastic elements like springs or rubber elements which push contacting elements towards contact areas when positioned accordingly.

While embodiments of the present invention have been described above, it is to be understood that the practice of the present invention is not limited to these embodiments, and modifications and deviations are possible for a person skilled in the art within the scope of the present invention. Moreover, while for the purpose of streamlining the present detailed description embodiments comprising a plurality of features have been described, this is not to be construed as indicating that all these features are necessary for practicing the present invention. In contrast, as apparent from the appended claims, embodiments of the present invention may include fewer features than the embodiments described above. The scope of the present invention is intended to be limited only by the appended claims and equivalents thereof.

What is claimed is:

1. A connector arrangement, comprising:

a connector body;

a first electrical connector coupled with the connector body;

a jacket to couple with the connector body and surround the first electrical connector and a second electrical connector arranged around said first electrical connector, where the second electrical connector is configured to be independently operable of said first electrical connector, and the second electrical connector comprises a plurality of connecting elements at least partially arranged within a body of the jacket.

2. The connector arrangement of claim 1, where the jacket comprises a shielding material.

3. The connector arrangement of claim 1, where the jacket comprises a locking mechanism to lock said jacket with a further connector arrangement to be connected to said connector arrangement.

4. The connector arrangement of claim 1, where the jacket is detachable from the connector body.

5. The connector arrangement of claim 1, where the jacket is reversibly deformable.

6. The connector arrangement of claim 1, where the jacket comprises a memory metal.

7. The connector arrangement of claim 4, where, when the jacket decouples from the connector body, the second electrical connector is rendered electrically inoperable and the first electrical connector remains electrically operable.

8. The connector arrangement of claim 1, where the jacket comprises an ejection mechanism which is configured such that, in a first state of said ejection mechanism, said connecting elements protrude from said jacket towards an outside of said jacket and, in a second state of said ejection mechanism, said connecting elements are located closer towards a center of said jacket than in said first state.

9. The connector arrangement of claim 8, where the ejection mechanism comprises an inner ring member and an outer ring member, said inner ring member being rotatable with respect to said outer ring member, said outer ring member comprising openings for said connecting elements, said inner ring member being coupled with said connecting elements to push said connecting elements through said openings in said first state.

10. The connector arrangement of claim 9, where the connecting elements comprise a plurality of pins, one end of each of said pins being coupled with said inner ring member, and where the pins are guided by said openings of said outer ring member.

11. The connector arrangement of claim 9, where the connecting elements comprise a plurality of balls, and where the inner ring member comprises a plurality of step elements at an outer surface thereof to move said balls between a first position associated with said first state and a second position associated with said second state.

12. The connector arrangement of claim 1, where the connector arrangement comprises a ring element surrounding said first electrical connector, where the second electrical connector comprises a plurality of contact areas arranged in said ring element.

13. An electrical device, comprising:

an electrical element; and a connector arrangement coupled to said electrical element, said connector arrangement comprising:

a connector body, a first electrical connector coupled with said connector body, a jacket to couple with the connector body and surround the first electrical connector, and a second electrical connector arranged around said first electrical connector, where the second electrical connector is configured to be operable independent of said first electrical connector, where the second electrical connector comprises a plurality of connecting elements at least partially arranged within a body of the jacket.

14. The electrical device of claim 13, where the jacket includes an ejection mechanism to alternately eject and retract each of the connecting elements via a respective opening in the jacket.

15. The electrical device of claim 13, where each of the connecting elements extend through an assigned opening in the jacket, by a first amount, in an electrically unconnected state and, by a second amount, in an electrically connected state, where the second amount is greater than the first amount.

16. The electrical device of claim 13, where, when the connecting elements are substantially entirely retracted to a position within the jacket, the second electrical connector is in an unconnected state.

17. The electrical device of claim 13, the jacket comprising a first portion and a second portion, where relative movement between the first portion and the second portion alternately pushes and retracts each of the contacting elements partially through an opening in the second portion.

18. The electrical device of claim 13, further comprising an ejection mechanism integrated in the jacket and configured for activation upon a particular movement of an outer portion of the jacket, where the activation of the ejection mechanism causes each of the connecting elements to partially protrude outside the jacket.

19. The connector arrangement of claim 13, where, when the jacket decouples from the connector body, the second electrical connector is rendered electrically inoperable and the first electrical connector remains electrically operable.

* * * * *